US008499404B2

(12) United States Patent
Spoleti et al.

(10) Patent No.: US 8,499,404 B2
(45) Date of Patent: Aug. 6, 2013

(54) QUICK CHANGE SQUEEGEE ASSEMBLY

(76) Inventors: Matteo Spoleti, Monroe Township, NJ (US); Tina C. Spoleti, Monroe Township, NJ (US)

( * ) Notice: Subject to any disclaimer, the term of this patent is extended or adjusted under 35 U.S.C. 154(b) by 246 days.

(21) Appl. No.: 12/838,986

(22) Filed: Jul. 19, 2010

(65) Prior Publication Data

US 2011/0035896 A1 Feb. 17, 2011

Related U.S. Application Data

(60) Provisional application No. 61/234,444, filed on Aug. 17, 2009.

(51) Int. Cl.
*A47L 1/06* (2006.01)

(52) U.S. Cl.
USPC ..... 15/245; 15/236.01; 15/121; 15/150

(58) Field of Classification Search
USPC ..... 15/245, 245.1, 236.01, 121, 145, 15/146, 150
See application file for complete search history.

(56) References Cited

U.S. PATENT DOCUMENTS 1,628,783 A * 5/1927 Jensen et al. ..... 15/245
2,225,432 A * 12/1940 Ginsbert ..... 15/245
2,261,475 A * 11/1941 Kautenberg ..... 15/245
3,892,005 A * 7/1975 Berns ..... 15/245
4,910,825 A * 3/1990 Mauer ..... 15/121
5,660,632 A * 8/1997 Volpe et al. ..... 118/213
5,930,863 A 8/1999 Samuelsson
5,946,762 A * 9/1999 Dionisio ..... 15/245
7,748,074 B2 7/2010 Guizzi
2004/0226126 A1* 11/2004 Cox et al. ..... 15/245
2006/0260084 A1* 11/2006 Guizzi ..... 15/245

* cited by examiner

*Primary Examiner* — Brian Glessner
*Assistant Examiner* — Brian D Mattei
(74) *Attorney, Agent, or Firm* — Porzio, Bromberg & Newman, P.C.

(57) ABSTRACT

The present invention relates to a quick change squeegee assembly for expeditiously replacing the blades of the assembly. A top rail is attached to a pole socket assembly. A hinged compression frame is attached to the top rail. The hinged compression frame includes hinge for coupling a pair of jaws to one another. A biasing member is positioned between the jaws for biasing the jaws away from one another. A plurality of springs can be used to bias the pair of jaws along the length thereof for holding within the jaws an inserted bladed securely along the length of the blade. Each spring can be associated with jaws using a T-bolt inserted through the threaded aperture of the spring, through an aperture of the hinged compression frame and through an aperture of the top rail. An adjustment knob is attached to the T-bolt. The adjustment knob can be activated by rotating in a clockwise or counterclockwise manner for closing and opening the jaws of the hinged compression frame.

10 Claims, 6 Drawing Sheets

QUICK CHANGE SQUEEGEE ASSEMBLY

CROSS REFERENCE TO RELATED APPLICATION

This application claims the benefit of U.S. Provisional Patent Application No. 61/234,444, filed Aug. 17, 2009, the entirety of which is hereby incorporated by reference into this application.

BACKGROUND OF THE INVENTION

Squeegee assemblies are known. U.S. Pat. No. 5,903,863 describes a squeegee including co-extensive stationary and moveable jaws joined medially by a fulcrum pin about which such moveable jaw is rocked by means of a lever arm handle. The lever arm handle projects outwardly through a notch to terminate in a thumb tab.

U.S. Pat. No. 7,748,074 describes a window squeegee for cleaning surfaces, such as skyscraper windows, comprises a handle associated to a head provided with a first connection element and a second connection element for connecting a spatula to the handle. In a condition of normal use of the window squeegee, the spatula is held between the first element and the second element and in a condition of replacement of the spatula, the second element is rotated by the first element to allow the replacement of the spatula which is held associated to the head of the window squeegee and is not free to remove, to ensure a safe replacement.

It is desirable to provide a improved quick change squeegee assembly with low manufacturing costs.

SUMMARY OF THE INVENTION

The present invention relates to a quick change squeegee assembly for expeditiously replacing the blades of the assembly. A top rail is attached to a pole socket assembly. A hinged compression frame is attached to the top rail. The hinged compression frame includes hinge for coupling a pair of jaws to one another. A biasing member is positioned between the jaws for biasing the jaws away from one another. The biasing member can be a flat spring having angled sides and threaded aperture in a top portion. A plurality of springs can be used to bias the pair of jaws along the length thereof for holding within the jaws an inserted bladed securely along the length of the blade. Each spring can be associated with jaws using a T-bolt inserted through the threaded aperture of the spring, through an aperture of the hinged compression frame and through an aperture of the top rail. An adjustment knob is attached to the T-bolt.

During operation, to change or replace a squeegee, the adjustment knobs are turned counterclockwise to allow the jaws of the hinged compression frame to open. The springs on the hinged compression frame hold the jaws open while changing the blade. The squeegee blade is installed between the jaws. Thereafter, the adjustment knobs are turned clockwise until tight for compressing the jaws against each side of the blade for a firm hold of the blade in place. Accordingly, the present invention provides a quick change squeegee assembly for securely holding the blade, and having low manufacturing costs for the parts of the assembly. The invention will be more fully described by reference to the following drawings.

DETAILED DESCRIPTION

Figure 1A:
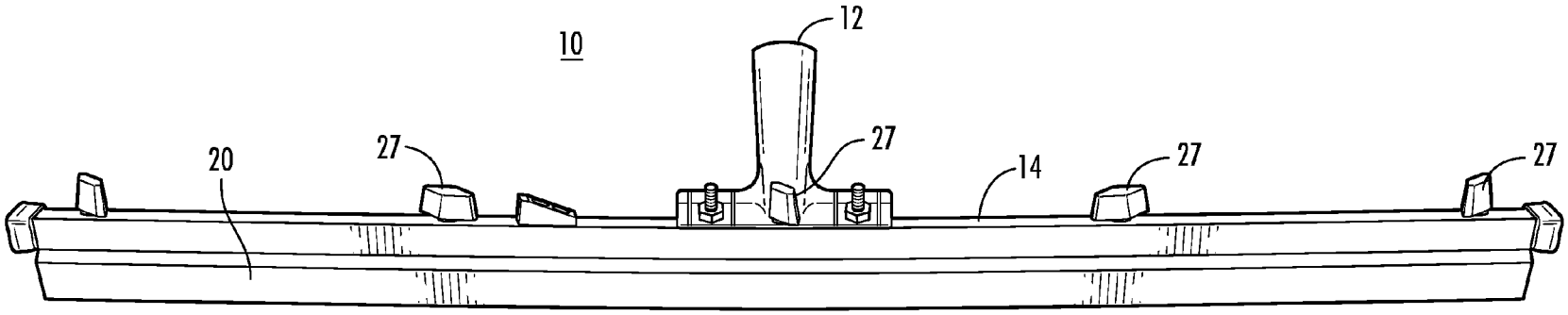
FIG. 1A is a front elevational view of the squeegee assembly including the top rail assembled to a hinged compression frame.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 1B:
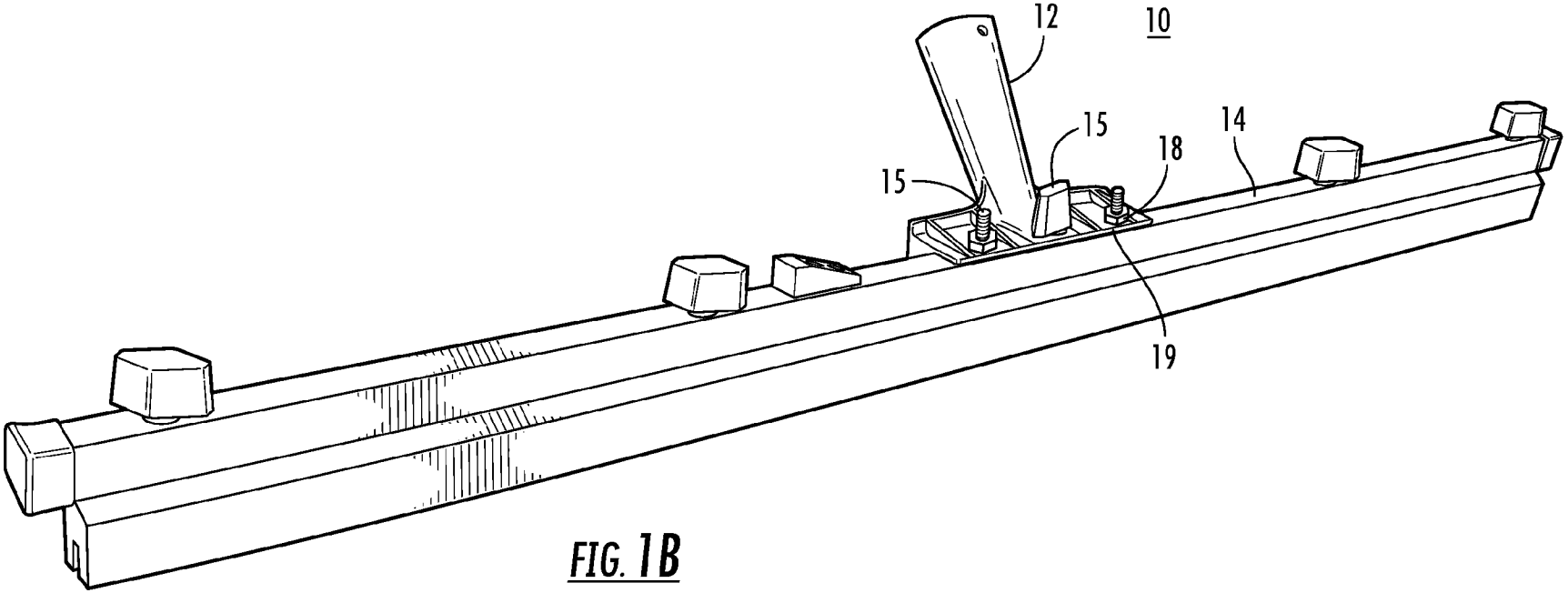
FIG. 1B is a front and side elevational view of the squeegee assembly shown in FIG. 1A.
Figure 1C:
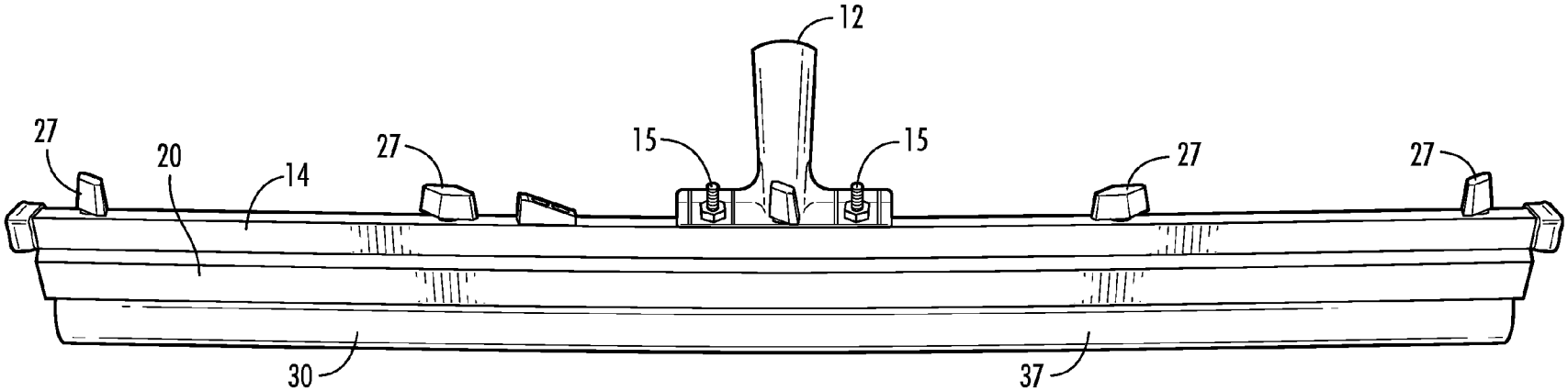
FIG. 1C is front elevational view of the squeegee assembly including an attached blade.
Figure 2:
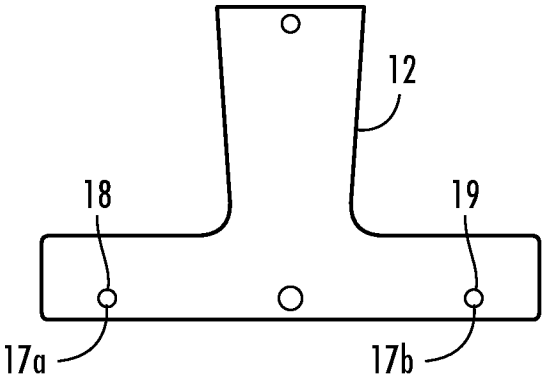
FIG. 2 is a front elevational view of a pole socket used in the squeegee assembly.
Figure 3A:
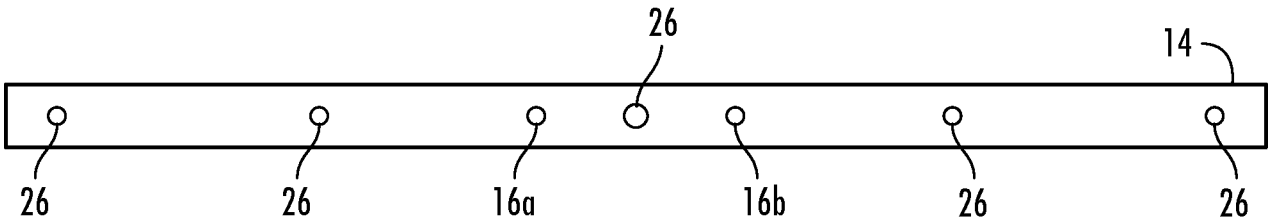
FIG. 3A is a front elevational view of the top rail.
Figure 3B:
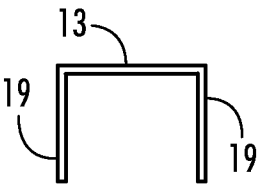
FIG. 3B is a side view of the top rail.

FIGS. 1A-1C illustrate squeegee assembly 10 in accordance with the teachings of the present invention. Pole socket assembly 12 is attached to top rail 14. In one embodiment, pole socket assembly 12 can be attached using bolts 15 which slide through apertures 16*a*, 16*b*, bottom of top rail 14 and apertures 17*a*, 17*b* of pole socket assembly 12, as shown in FIGS. 2 and 3. For example, bolts 15 can be 3/16 inch bolts. Lock washer 18 and nut 19 can be attached to inserted bolts 15 for attaching pole socket assembly 12 to top rail 14. Top rail 14 can include a plurality of apertures 26 positioned in top surface 18 of top rail 14, as shown in FIG. 3A. Legs 19 of top rail 14 can extend from top surface 13, as shown in FIG. 3B. For example, top rail 14 can be formed of Aluminum.

Hinged compression frame 20 is attached to top rail 14, as shown in FIGS. 4-7. In an alternate embodiment, hinged compression frame 20 is integral with top rail 14. Hinged compression frame 20 includes hinge 31 for coupling jaws 32 to one another, as shown in FIGS. 7A-7C. Hinge 31 allows jaws 32 to move toward and away from each other. Jaws 32 include angled portion 33 and longitudinal portion 34. Biasing member 21 is positioned between jaws 32 for biasing jaws 32 of hinged compression frame 20 away from one another. For example, hinged compression frame 20 can be formed of Aluminum.

Figure 4A:
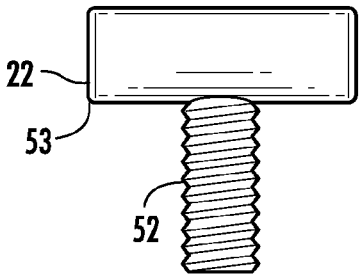
FIG. 4A is a front elevational view of a T-bolt used in the squeegee assembly.
Figure 4B:
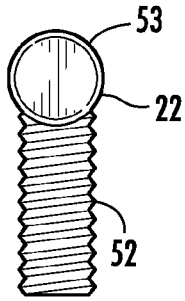
FIG. 4B is a side view of the T-bolt.
Figure 5A:
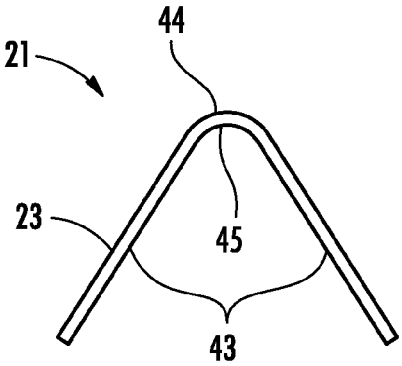
FIG. 5A is a side view of a flat spring used in the squeegee assembly.
Figure 5B:
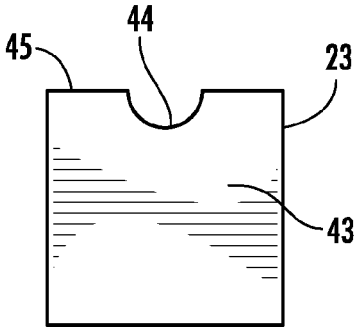
FIG. 5B is a front view of the flat spring.
Figure 6A:
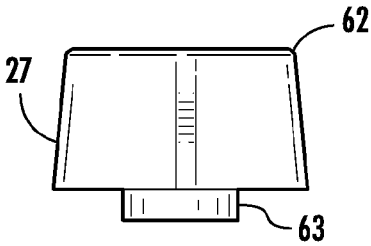
FIG. 6A is front view of an adjustment knob used in the squeegee assembly.
Figure 6B:
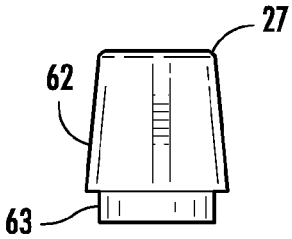
FIG. 6B is a side view of the adjustment knob.
Figure 7A:
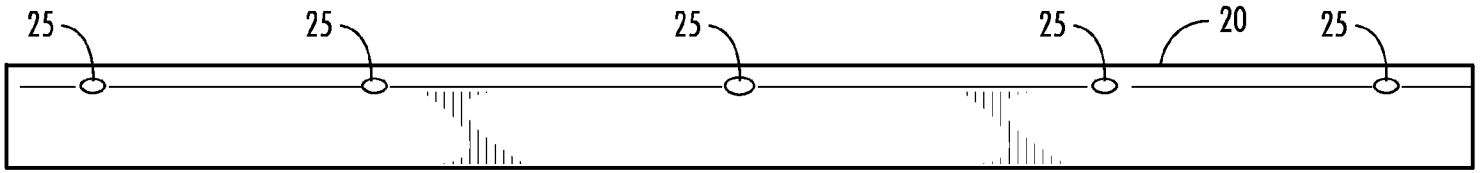
FIG. 7A is a front view of the hinged compression frame.

In one embodiment, biasing member 21 is spring 23. For example, spring 23 can be a flat spring having angled sides 43 and threaded aperture 44 in top portion 45, as shown in FIGS. 5A and 5B. A plurality of springs 23 can be used to bias jaws 32 along the length thereof. Each spring 23 can be associated with jaws 32 using T-bolt 22 inserted through threaded aperture 44, through aperture 25 of hinged compression frame 20 and through aperture 26 of top rail 14. T-bolt 22 can include threaded end 52 and head 53, as shown in FIGS. 4A and 4B. Adjustment knob 27 is attached to T-bolt 22. Adjustment knob 27 can include knob 62 and thread 63, as shown in FIGS. 6A and 6B. Thread 63 can be attached to threaded end 52 of T-bolt 22. In one embodiment, hinged compression frame 20 is attached to top rail 14 using the following steps. Step 1: place one T-bolt 22 through each spring 23 and repeat for number of T-bolts used, i.e., five times. Step 2: place each T-bolt 22 and spring 23 through apertures 25 in hinged compression frame 20, i.e., repeat 5 times. Step 3: slide each T-bolt 22 inserted through aperture 25 of hinged compression frame 20 into respective aperture 26 of top rail 14, i.e., five times. Step 4: install adjustment knobs 27 on each T-bolt 22, i.e., for a total of five locations. For example, apertures 25 and 26 can have ¼ inch diameters. For example, T-bolts 22 can be ¼ inch bolts. It will be appreciated that any number of T-bolts 22 and springs can be used for biasing jaws 32 along the length of compression frame 20.

Example parts list is five T bolts 22; five springs 23; five adjustment knobs 27; two bolts 15; two nuts 19; two lock washers 18; one pole socket assembly 12; one top rail 14 and one hinged compression frame 20.

Figure 8:
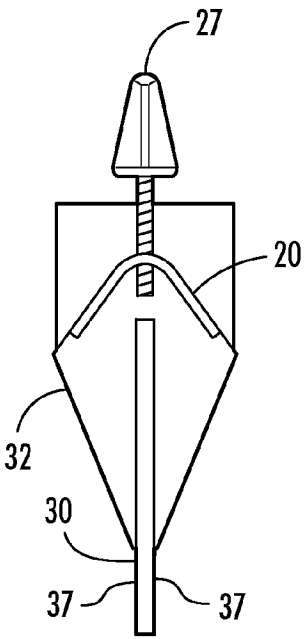
FIG. 8 is a schematic diagram of attachment of the blade to the squeegee assembly.
Figure 7C:
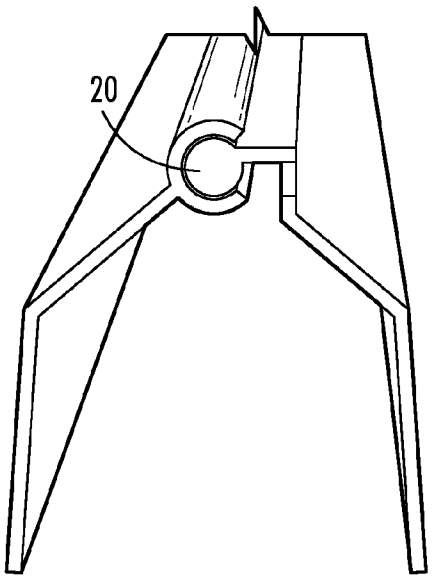
FIG. 7C is a perspective end and top view of the hinged compression frame.
Figure 7B:
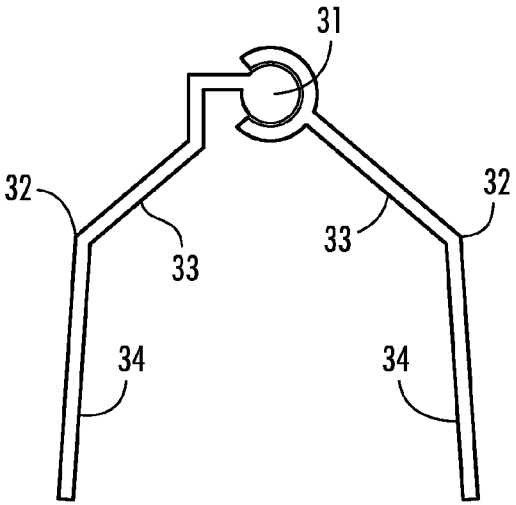
FIG. 7B is an end view of the hinged compression frame.

During operation, to change or replace squeegee blade 30, the following steps are performed and as shown in FIG. 8: Turn adjustment knobs 27 counterclockwise moving spring 23 downwards within hinged compression frame 20 to allow jaws 32 of hinged compression frame 20 to open. Install squeegee blade 30 between jaws 32. Turn adjustment knobs 27 clockwise until tight moving spring 23 upwards to allow jaws 32 to contact each side 37 of blade 30.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A squeegee assembly comprising:

a hinged compression frame including a pair of jaws coupled to one another with a hinge, at least one biasing member for biasing said jaws away from one another, and an adjustment member for adjusting said biasing member to move said jaws between an open and closed position, wherein said jaws are adapted for receiving a blade in the open position and said adjustment member adjusting said biasing member to move said jaws to the closed position for holding said blade between said jaws wherein at least one biasing member is a flat spring having a pair of angled sides extending from a top portion and an aperture in said top portion.

2. The squeegee assembly of claim 1 wherein said adjustment member includes a thread which is attached to a threaded end of a bolt received in the aperture of the top portion of said biasing member and an aperture of said hinged compression frame.

3. The squeegee assembly of claim 2 wherein said adjustment member includes a knob at an opposite end of said thread and wherein said adjustment member is rotated counterclockwise to open said jaws and said knob is rotated clockwise to close said jaws.

4. The squeegee assembly of claim 3 wherein said bolt is a T-bolt having a head at an opposite end of said threaded end of said bolt.

5. The squeegee assembly of claim 4 further comprising a top rail, said hinged compression frame being attached or integral to said top rail.

6. The squeegee assembly of claim 5 wherein said top rail includes an aperture and said threaded end of said bolt being received in the aperture of said top rail, said knob being attached to said threaded end of said bolt after said bolt is inserted into the aperture of said spring, the aperture of said hinged compression rail and the aperture of said top rail.

7. The squeegee assembly of claim 6 wherein said top rail formed is formed of aluminum.

8. The squeegee assembly of claim 5 further a pole socket assembly being coupled to said top rail.

9. The squeegee assembly of claim 1 including a plurality of the biasing members for biasing said jaws along the length thereof.

10. The squeegee assembly of claim 1 wherein said hinged compression frame is formed of aluminum.

* * * * *